US005832392A

United States Patent [19]

Forsberg

[11] Patent Number: 5,832,392

[45] Date of Patent: Nov. 3, 1998

[54] DEPLETED URANIUM AS A BACKFILL FOR NUCLEAR FUEL WASTE PACKAGE

[75] Inventor: Charles W. Forsberg, Oak Ridge, Tenn.

[73] Assignee: The United States of America as represented by the United States Department of Energy, Washington, D.C.

[21] Appl. No.: 858,189

[22] Filed: Apr. 15, 1997

Related U.S. Application Data

[60] Provisional application No. 60/019,974 Jun. 17, 1996.

[51] Int. Cl.[6] ..... G21F 9/00

[52] U.S. Cl. ..... 588/16; 588/17; 250/506.1; 376/274; 976/DIG. 328; 976/DIG. 329

[58] Field of Search ..... 588/15, 16, 17; 376/274; 976/DIG. 328, DIG. 329; 405/128; 250/506.1; 420/3; 75/246

[56] References Cited

U.S. PATENT DOCUMENTS

| | | | |
|---|---|---|---|
| 3,039,000 | 6/1962 | Kieffer et al. . | |
| 3,888,795 | 6/1975 | Kasberg . | |
| 3,962,587 | 6/1976 | Dufrane et al. . | |
| 4,650,518 | 3/1987 | Arntzen et al. . | |
| 4,914,306 | 4/1990 | Dufrane et al. . | |
| 4,950,426 | 8/1990 | Markowitz et al. . | |
| 5,015,863 | 5/1991 | Takeshima et al. . | |
| 5,464,988 | 11/1995 | Rossmassler et al. . | |
| 5,545,796 | 8/1996 | Roy et al. | 588/4 |

OTHER PUBLICATIONS

Cogar, J. A., et al, "Waste Package Filler Material Testing Report", BBA000000–01717–2500–00008REV00, U.S. Department of Energy, Las Vegas, Nevada, Apr. 22, 1996.

Zoller, J.N., et al Depleted Uranium Hexafluoride Management Program, Lawrence Livermore National Laboratory, vol. I–Report, pp. 7–352 to 7–363, UCRL–AR–120372, Jun. 30, 1995 (Description of Inventor's own work).

Forsberg, C.W. et al "DUSCOBS—A Depleted–Uranium Silicate Backfill for Transport, Storage, and Disposal of Spent Nuclear Fuel", ORNL/TM–13045, Martin Marietta Energy Systems, Oak Ridge National Laboratory, Oak Ridge, TN, Nov. 30, 1995 (Description of Inventor's own work).

Teper, B. Particulate Compaction Tests for a Particulate–Packed Thin–wall Container for Irradiated–Fuel Disposal, Atomic Energy of Canada Limited Research Co., TR–131, Dec. 1980.

Crosthwaite, J.L., "The Performance, Assessment and Ranking of Container Design Options for the Canadian Nuclear Fuel Waste Management Program", TR–500, COG–93–410, AECL, Nov. 1994.

*Primary Examiner*—Ngoclan Mai

*Attorney, Agent, or Firm*—Emily G. Schneider; Stephen D. Hamel; William R. Moser

[57] ABSTRACT

A method for packaging spent nuclear fuel for long-term disposal in a geological repository. At least one spent nuclear fuel assembly is first placed in an unsealed waste package and a depleted uranium fill material is added to the waste package. The depleted uranium fill material comprises flowable particles having a size sufficient to substantially fill any voids in and around the assembly and contains isotopically-depleted uranium in the +4 valence state in an amount sufficient to inhibit dissolution of the spent nuclear fuel from the assembly into a surrounding medium and to lessen the potential for nuclear criticality inside the repository in the event of failure of the waste package. Last, the waste package is sealed, thereby substantially reducing the release of radionuclides into the surrounding medium, while simultaneously providing radiation shielding and increased structural integrity of the waste package.

14 Claims, 2 Drawing Sheets

DEPLETED URANIUM AS A BACKFILL FOR NUCLEAR FUEL WASTE PACKAGE

The United States Government has rights to this invention pursuant to Contract No. DE-AC05-96OR22464 with Lockheed Martin Energy Research Corporation, awarded by the U.S. Department of Energy.

BACKGROUND OF THE INVENTION

This application claims the benefit of U.S. Provisional Application No. 60/019,974, filed Jun. 17, 1996. This invention relates generally to a method for packaging spent nuclear fuel for disposal and more particularly to a method for packaging spent nuclear fuel for long-term disposal in a geological repository using a depleted uranium fill material.

Spent nuclear fuel (SNF) assemblies from light-water reactors comprise bundled sets of fuel rods consisting of Zircaloy metal tubes containing uranium dioxide fuel pellets in which fission products and actinides are incorporated. The disposal of spent nuclear fuel assemblies is problematic because the spent nuclear fuel remains hazardous for tens of thousands of years. The basic approach for disposal of spent nuclear fuel is to store it until the radioactivity has decayed to non-hazardous levels by placing the spent nuclear fuel in specially-designed waste packages and burying the contained fuel deep underground in a geological repository. This method is limited because if the stored waste packages fail, radionuclides in the spent nuclear fuel are released into the subterranean groundwater and transported to the open environment.

Another problem in this disposal method is the potential for nuclear criticality inside the repository. Nuclear criticality may occur when the fissile concentration (primarily uranium-235 and plutonium-239 in the spent nuclear fuel) is high and there is a lack of neutron absorbers. Over time, the plutonium-239 decays to uranium-235, and thus, the criticality problem is primarily associated with uranium-235. Nuclear criticality is a concern in a geological repository because the reaction generates heat. Heat accelerates the degradation of the waste packages and the contained spent nuclear fuel, which in turn, accelerates the release of radionuclides from the waste packages to the open environment. Heat also accelerates the movement of groundwater that can transport radionuclides to the environment. Although nuclear criticality can be minimized in geological repositories by the use of neutron absorbers in the waste packages and by geometric spacing of fissile materials, neutron absorbers can leach from waste packages and travel at different rates through the geology than the spent nuclear fuel uranium. This phenomenon creates the potential for criticality events if the fissile concentration in the repository is sufficiently high, and it has been shown that the fissile content of light-water reactor spent nuclear fuel is sufficient to cause nuclear criticality.

In addition to the disadvantages associated with the disposal of spent nuclear fuel in geological repositories, the waste packages themselves have limitations with respect to package design and structural integrity. Conventional waste package systems are designed with radiation shielding located externally which makes the packages heavy and difficult to handle and load. Further, existing Nuclear Regulatory Commission requirements are extremely stringent with respect to the nuclear criticality potential for the storage and transport of spent nuclear fuel and thus sometimes waste packages cannot be fully loaded with spent nuclear fuel. Finally, in order to prevent movement of fissile materials under accident conditions, waste packages containing spent nuclear fuel are frequently large and bulky.

Several studies have investigated the use of various inert fill materials for packaging spent nuclear fuel in waste packages for underground disposal. Steel shot fill material has been tested on light-water reactor spent nuclear fuel dummy fuel elements, however, steel shot cannot effectively reduce the long-term potential for nuclear criticality in the geological repository. Canada has tested the effectiveness of sand as a fill material to provide package support in waste packages containing simulated Canadian Deuterium Uranium spent nuclear fuel, but there is no concern about the potential for nuclear criticality in a repository because the Canadian reactor fuel is made of natural uranium with a low uranium enrichment level.

Accordingly, a need in the art exists for an improved method for packaging spent nuclear fuel in a waste package for disposal in a geological repository which inhibits dissolution of spent nuclear fuel from spent nuclear fuel assemblies into a surrounding medium and lessens the potential for nuclear criticality inside the repository in the event of failure of the waste package, thereby substantially reducing the release of radionuclides from the waste package into the surrounding medium, while simultaneously providing radiation shielding and increased structural integrity of the waste package.

SUMMARY OF THE INVENTION

In view of the above need, it is an object of this invention to provide a method for packaging spent nuclear fuel in a waste package for disposal in a geological repository using a fill material containing isotopically-depleted uranium in the +4 valence state in an amount sufficient to inhibit dissolution of spent nuclear fuel from spent nuclear fuel assemblies into a surrounding medium in the event of failure of the waste package.

Another object of this invention is to provide a method as in the above object which lessens the potential for nuclear criticality inside the repository.

Further, it is an object of this invention to provide a method as in the above objects which substantially reduces the release of radionuclides from the waste package into a surrounding medium.

It is also an object of this invention to provide a method as in the above objects which simultaneously provides radiation shielding and increased structural integrity of the waste package.

Briefly, the present invention is a method for packaging spent nuclear fuel for disposal in a geological repository comprising the steps of placing at least one spent nuclear fuel assembly in an unsealed waste package; adding a fill material to the waste package comprising flowable particles having a size sufficient to substantially fill any voids in and around the assembly and containing depleted uranium in the +4 valence state in an amount sufficient to inhibit dissolution of the spent nuclear fuel from the assembly into a surrounding medium and to lessen the potential for nuclear criticality inside the repository in the event of failure of the waste package, and sealing the waste package to allow for disposal of the assembly, thereby substantially reducing the release of radionuclides from the waste package in the event of failure of the waste package, while simultaneously providing radiation shielding and increased structural integrity of the waste package.

Additional objects, advantages, and novel features of the invention will be set forth in part in the description which follows, and in part will become apparent to those skilled in the art upon examination of the following or may be learned by the practice of the invention. The objects and advantages may be realized and attained by means of the instrumentalities and combinations particularly pointed out herein and in the appended claims.

BRIEF DESCRIPTION OF THE DRAWINGS

The accompanying drawings, which are incorporated in and form a part of the specification, illustrate preferred embodiments of the invention, and together with the description, serve to explain principles of the invention.

FIG. 1, which includes

Like reference numbers indicate identical parts.

DETAILED DESCRIPTION

"Depleted uranium", as used in the specification and claims" means uranium depleted in fissile isotopes.

A "waste package", as used in the following specification and claims, means any suitable receptacle for sealably containing at least one spent nuclear fuel assembly for long-term disposal in a geological repository.

"Dissolution of spent nuclear fuel", as used in the specification and claims, means the conversion of spent nuclear fuel into radionuclides in the form of (1) soluble chemical compounds in groundwater, and (2) colloids (small particulates) that can be transported by groundwater, i.e. converting actinides and fission products, such as plutonium-239, plutonium-241, uranium-233, uranium-235, technetium, and neptunium into chemical and physical forms transportable in groundwater.

The present invention is a method for packaging spent nuclear fuel for disposal in a geological repository using a fill material, hereinafter referred to as a "depleted uranium fill material", containing depleted uranium in the +4 valence state in an amount sufficient to inhibit dissolution of spent nuclear fuel from the spent nuclear fuel assembly into a surrounding medium and to lessen the potential for nuclear criticality inside the repository in the event of failure of the waste package. The depleted uranium fill material comprises flowable particles, preferably in the form of generally spherical beads.

Figure 1A:
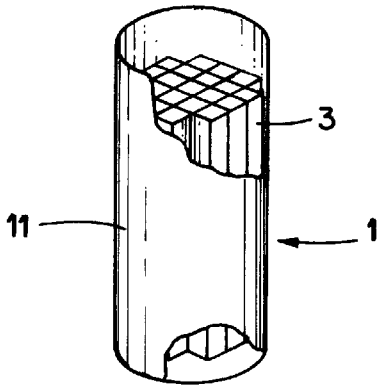
FIGS. 1A–1D, is a flow diagram which illustrates the loading sequence for filling a large waste package with spent nuclear fuel assemblies and depleted uranium fill material in accordance with the present invention.
Figure 1B:
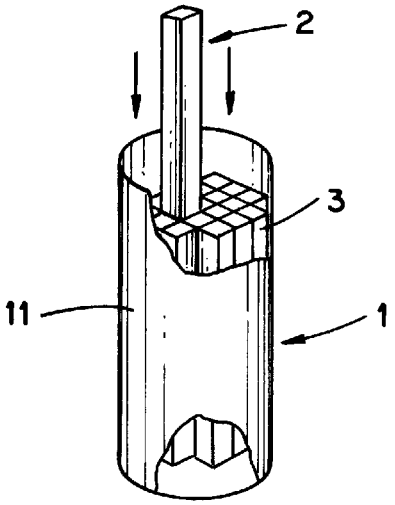

Referring now to FIGS. 1A and 1B, at least one spent nuclear fuel assembly 2 is first placed in an unsealed waste package 1. The waste package, which holds 21 spent nuclear fuel assemblies, is typical of package designs being considered today for spent nuclear fuel disposal. The waste package typically includes a thick-walled cylinder 11 made of steel. The thick walls provide (1) high structural strength against handling accidents, (2) provide radiation shielding to reduce radiation interactions with the rock inside the repository and (3) provide radiation shielding to protect people from the highly-radioactive spent nuclear fuel assemblies.

Figure 1C:
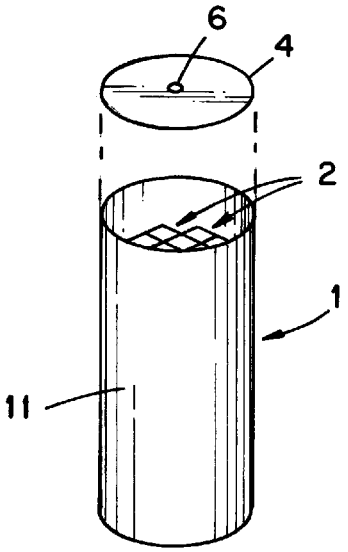
Figure 1D:
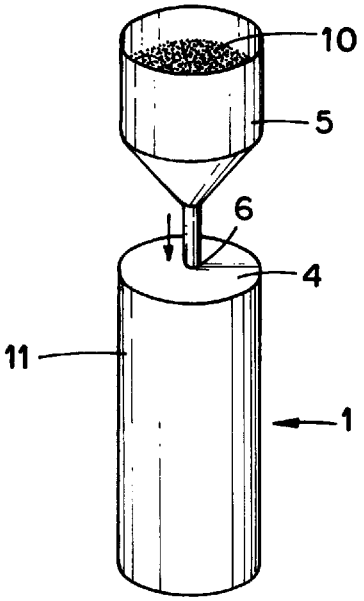

As shown in FIG. 1A–1C, the waste package contains a fuel basket 3 in the form of an elongated rectangular grid which holds the spent nuclear fuel assemblies in place that extends most (but not all) of the distance from the bottom to the top of the waste package. A typical light-water reactor fuel assembly is ~4 m long, ~21 cm wide, and ~21 cm deep. The loading of the 21 spent nuclear fuel assemblies is done remotely with the waste package and spent nuclear fuel underwater or in a shielded room to protect the operators against the high-radiation fields from the spent nuclear fuel. As shown in FIG. 1C, after all the spent nuclear fuel assemblies 2 are loaded, a thick-walled steel lid 4, which has a small hole 6, is placed on the waste package 1 and welded in place. With the lid in place, operators may approach the waste package. As shown in FIG. 1D, the depleted uranium fill material 10 comprising flowable particles or beads is next added to the waste package from a hopper 5 through the hole 6 in the lid 4 on the top of the waste package 1. The waste package and hopper may be vibrated to assist the flow of particles or beads into the waste package where the beads or particles fill all the voids within the fuel assemblies and between the fuel basket and cylinder 11. After the waste package is filled, the hole 6 is sealed shut and the waste package is readied for transport and disposal in the geological repository.

Figure 2:
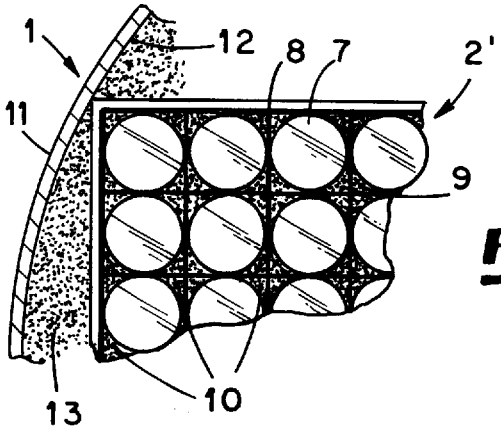
FIG. 2 is a partial top view of one spent nuclear fuel assembly inside a waste package adjacent to the interior wall of the waste package and shows the depleted uranium fill material in and around the assembly.
Figure 3:
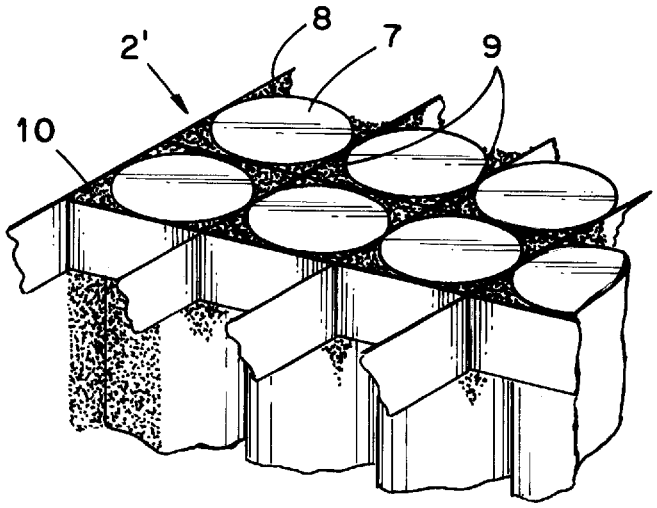
FIG. 3 is a perspective cut away of a portion of a spent nuclear fuel assembly and the depleted uranium fill material in and around individual fuel rods supported within the assembly.

As shown in FIGS. 2 and 3, in the fuel assembly 2', the fuel rods 7 are held together by an eggcrate-type spacer grid 8. This spacer grid is typically 1–2 cm high with 5 to 10 spacer grids along the vertical height of the fuel assembly to hold the rods in place. The spaces 9 between the rods 7, referred to as coolant channels, provide space between the fuel rods for flow of cooling water or other fluids when the nuclear fuel assemblies are in a nuclear reactor. The depleted uranium fill material 10 substantially fills any voids in the assembly 2', including the coolant channels 9, and any voids around the assembly, such as the space 13 between the assembly 2' and the interior wall 12 of the thick-walled cylinder 11 of waste package 1. Because the void space in the waste package containing the spent nuclear fuel assemblies can be calculated, the quantities of fill material needed to fill the waste package is known.

There are several variants on the loading procedure. For example, there may be more than one hole in the lid of the waste package. In addition, the flowable particles or beads can be loaded after the spent nuclear fuel is loaded into the waste package, but before the waste package lid is placed on the waste package. This method would require that the bead loading activities be conducted remotely.

Depleted uranium silicate glasses which could be used in the method of the present invention include, but are not limited to, uranium borosilicate glass, uranium loffler glass, uranium soda lime glasses, and pure uranium silicate. The depleted uranium silicate glasses can be fabricated by methods known in the art to incorporate the optimal physical and chemical characteristics depending on a variety of factors such as waste package design, enrichment levels of the spent nuclear fuel, geochemical considerations of the repository, and economics. Uranium glasses have been produced on a laboratory scale using standard glass-making technologies.

Depleted uranium dioxide could also be used as the depleted uranium fill material. Depleted uranium dioxide can be made into beads or other flowable particles by a variety of processes known in the art developed for fuel fabrication. In addition, other uranium oxide materials such as $U_3O_8$ could also be used as a fill material.

Another advantage the method of the present invention provides is a means to dispose of significant quantities of excess depleted uranium from uranium enrichment plants at potential economic savings. The U.S. Nuclear Regulatory Commission has stated that some type of deep disposal of this material will be required if it is declared a waste. The current inventory of depleted uranium is approximately 400,000 tons and has limited uses.

The size of the beads or flowable particles comprising the depleted uranium fill material would be in the range of from about 0.1 to about 1 mm in size or diameter for light-water reactor spent nuclear fuel. The underlying requirement for any type of spent nuclear fuel is that the beads or flowable particles be of a size sufficient to substantially fill the voids formed by the coolant channels between the spent nuclear fuel rods in the assemblies and also into the voids between the assembly and the interior of the waste package.

As stated above, the amount of depleted uranium (uranium-238) contained in the fill material depends on several factors, such as the enrichment levels of the spent nuclear fuel. Thus, the typical average enrichment level of light-water reactor spent nuclear fuel is about 1.47 wt. % consisting primarily of uranium-235 and plutonium-239, although the enrichment level of light-water reactor spent nuclear fuel can range generally from about 0.9 to 5 wt. %. Accordingly, in the method of the present invention, it is preferred that the isotopic uranium content of the depleted uranium fill material would comprise primarily uranium-238 in the range of about 99.6 to 99.8 wt. % and have an enrichment level in the range of from about 0.2 to about 0.4 wt. % of uranium-235 equivalent. Generally, the solid density of the depleted uranium fill material would be in the range of from about 4 to 11 g/cm$^3$. More specifically, the depleted uranium silicate glass fill material would have a range of from about 4 to 8 g/cm$^3$, while the depleted uranium dioxide fill material would have a solid density of from about 10 to 11 g/cm$^3$. The particulate density of the fill material would be in the range of from about 2.0 to about 9.9 g/cm$^3$.

As will be discussed below, it is generally desired that the final enrichment level of the waste package to be stored in the repository be below 1.3 wt. % and preferably below 1 wt. % uranium-235 equivalent to minimize the potential for long-term criticality in the repository. The isotopic dilution of a complex mixture of fissile isotopes to 1 wt % U-235 equivalent is the addition of sufficient U-238 to the mixture such that the potential for nuclear criticality of the mixture is equivalent to U-235 isotopically diluted to 1 wt % with U-238. Thus, for a waste package containing plutonium-239, uranium-235, and uranium-238, this is represented by the following equation: [(plutonium-239+uranium-235/(plutonium-239+uranium-235+uranium-238)]×100%<1 wt. %. Only fissile and fertile materials are included in this calculation. Oxygen, silicon, and other materials are not included.

The use of a depleted uranium fill material in the method of the present invention substantially reduces the release of radionuclides from the spent nuclear fuel into a surrounding medium in the event of failure of the waste package. In light-water reactor spent nuclear fuel assemblies as described above, most of the fission products and actinides are incorporated into the uranium dioxide fuel pellets. These radionuclides cannot escape until there is dissolution of the spent nuclear fuel. Over time, waste package systems stored in underground geological repositories can degrade and groundwater can enter the package and begin to dissolve the uranium dioxide fuel pellets. With the dissolution of the uranium dioxide, the soluble radionuclides in the uranium dioxide dissolve into the groundwater, and some form colloids that flow with the water.

The depleted uranium fill material inhibits the dissolution of the spent nuclear fuel uranium dioxide by different mechanisms, depending on whether the waste package is in an oxidizing or reducing environment. The choice of using depleted uranium dioxide or depleted uranium silicate glass fill material in the method of the present invention depends on, among other factors, the enrichment level of the spent nuclear fuel and groundwater conditions.

Under oxidizing groundwater conditions, the use of either depleted uranium dioxide or depleted uranium silicate glass fill material having uranium-238 which is in the +4 valence state ensures chemically reducing conditions within the waste package for an extended period of time independent of the surrounding groundwater chemistry. The solubility of uranium in such a reducing environment is very low (about 1 ppb) and is about two to four orders of magnitude, depending upon specific conditions, less than the solubility of uranium under oxidizing conditions. Thus, radionuclide releases are extremely limited under chemically reducing conditions because the uranium dioxide fuel matrix does not dissolve and release the radionuclides incorporated in its structure. This reducing environment results, because upon breach of the waste package, any oxygen in the groundwater first encounters the depleted uranium fill material before it encounters the spent nuclear fuel. The depleted uranium in the +4 valence state is oxidized to the +6 valence state through a series of oxidation steps, thus removing the oxygen from the groundwater. Such chemically reducing conditions also minimize the solubility of other fission products such as neptunium and technetium and reduce the formation and transport of colloids.

In addition, water and air, together with the radiation field produced by the spent nuclear fuel assembly, generate corrosive oxidizing acids that can degrade the waste package and accelerate dissolution of the spent nuclear fuel. Although waste packages are dried and filled with inert gases before sealing to minimize this problem, the use of the depleted uranium fill material reduces acid generation after the waste package has degraded over time. The high density fill material reduces internal radiation fields by a factor of 2 to 3 by absorbing gamma rays, and the available air or water volume for acid generation in the waste package is decreased by displacement with the depleted uranium fill material.

Another mechanism by which the depleted uranium fill material reduces radionuclide release under oxidizing conditions is by saturation of the surrounding groundwater with depleted uranium. The beads or other flowable particles comprising the depleted uranium fill material have a high surface area and thus, when groundwater enters the failed waste package, the depleted uranium in the beads or particles saturates the intruding groundwater with uranium. Because the rate of uranium dissolution and transport (when kinetics do not further reduce dissolution rates) is proportional to the difference between the uranium concentration in the water at the spent nuclear fuel uranium dioxide surface and the solubility of uranium in the groundwater, groundwater saturated in uranium cannot dissolve the uranium fuel pellets in the spent nuclear fuel assembly. Accordingly, the amount of radionuclides released into the surrounding groundwater is reduced.

Once the above-described chemically reducing conditions induced by use of the fill material no longer exist in an oxidizing environment, the use of depleted uranium silicate glass containing uranium in the +4 valence state in the method of the present invention also inhibits spent nuclear fuel dissolution by several mechanisms. First, uranium silicate is much less soluble in most groundwater than most other uranium compounds, including uranium oxides in oxidizing groundwater. This lower solubility reduces the quantity of uranium that can dissolve in a unit of groundwater, and thus it will take longer for the uranium in the waste package to be dissolved and transported, thereby reducing the release of radionuclides to the environment. Second, the groundwater saturated with uranium silicate from the fill material also helps form insoluble layers of uranium silicates around the uranium dioxide fuel pellets in the spent nuclear fuel which kinetically slow spent nuclear fuel alteration and dissolution. In addition, it is observed that most groundwater contains silicates, thus if the material is depleted uranium dioxide, uranium silicates will form over time with the silicates from the groundwater.

Another means by which the depleted uranium fill material minimizes the release of radionuclides under oxidizing conditions is by reducing the flow of groundwater within the waste package. Under oxidation conditions, the depleted uranium dioxide fill material oxidizes to lower-density hydrated uranium oxides. This reaction results in an expansion of the depleted uranium fill material which prevents ingress of water and gas into the waste package.

In a geological repository having chemically reducing groundwater conditions, a depleted uranium fill material consisting of depleted uranium dioxide having uranium in the +4 valence state is preferred. The depleted uranium dioxide fill material helps maintain strong chemically reducing conditions in the waste package that minimize the oxidation and dissolution of the spent nuclear fuel uranium dioxide. In addition, the depleted uranium saturates the groundwater surrounding the spent nuclear fuel with uranium which further reduces dissolution of the spent nuclear fuel. Last, the depleted uranium dioxide fill material also minimizes the generation of oxidizing acids from interaction of radiation with air or water in the waste package by (1) displacing water from the waste package, and (2) gamma-ray shielding which lowers the radiation levels within the waste package.

Use of the depleted uranium fill material in the method of the present invention also reduces the release of radionuclides to the environment by lessening the potential for nuclear criticality in the geological repository. As stated above, nuclear criticality generates heat which accelerates the release of radionuclides from the waste package to the surrounding groundwater and also accelerates the movement of the contaminated groundwater to the open environment. Neutron absorbers used in conventional waste package systems to prevent nuclear criticality, such as boron and gadolinium, can leach from the waste packages and separate from the uranium by dissolution in groundwater. If the amount of spent nuclear fuel remaining in the waste package is sufficiently enriched, nuclear criticality within the waste package may occur (package criticality). Furthermore, in situations where multiple waste packages are stored in a repository, once groundwater enters the degraded waste packages, the uranium contained in the spent nuclear fuel is dissolved in the groundwater and can reprecipitate outside of the breached waste package in concentrated form, similar to the process which forms natural uranium ore bodies. If the enrichment level of this concentrated uranium is sufficiently high, there is the potential for nuclear criticality with the uranium from the multiple waste packages (zone criticality). Studies have shown that the average expected fissile concentration of light-water reactor spent nuclear fuel (1.47 wt. %) in some geological repositories is sufficient to cause nuclear criticality, although whether criticality will in fact occur depends upon the long-term evolution of chemical conditions within the repository.

In the present invention, the addition of the depleted uranium fill material to a waste package containing spent nuclear fuel assemblies lessens the potential for nuclear criticality by lowering the uranium enrichment level in the waste package and, consequently, in the repository as a whole, below 1.3 wt. % and preferably below 1 wt. % uranium-235 equivalent. In the distant past (~2 billion years ago) some uranium ore bodies became naturally occurring nuclear reactors with initial enrichments of 3.6 wt % uranium-235 equivalent and enrichment levels at shutdown approaching 1.3 wt % uranium-235 fissile equivalent. This real world experience indicates that if enrichment levels are above 1.3 wt %, nuclear criticality can occur in the natural environment and may occur in a repository. Theoretical and laboratory studies show that if enrichment levels are below 1 wt. % in individual waste packages and the respository has a whole, nuclear criticality is not a significant concern. The final wast package enrichment level desired will depend upon the chosen waste package system design.

This is lowering of the enrichment level occurs because, after groundwater enters the failed waste package, the uranium-238 in the depleted uranium fill material and the spent nuclear fuel uranium-235 transform into the same chemical compounds with the same chemical characteristics, and thus do not separate from one another over time. This isotopic dilution of the spent nuclear fuel uranium results in an enrichment level insufficient for nuclear criticality in the geological repository. There are a number of fissile isotopes (plutonium-239, plutonium-241, etc.) that can cause nuclear criticality. If fissile isotopes other than uranium-235 are in the spent nuclear fuel, their equivalence in terms of uranium-235 is used to determine how much depleted uranium fill material should be added to assure that nuclear criticality cannot occur. Furthermore, it should be noted that while over half of the fissile content of light-water reactor spent nuclear fuel may be plutonium-239, the above analysis is based on the assumption that plutonium remains with the uranium until the plutonium-239 decays to uranium-235 and can be isotopically diluted by the depleted uranium fill material, so long as the rate of plutonium decay to uranium is faster than the rate of dissolution and transport of uranium within the repository.

In addition to the above advantages, the addition of the depleted uranium fill material in the waste package also provides radiation shielding, thus allowing for the gamma shielding in the waste package walls external to the spent nuclear fuel assemblies to be decreased. Locating the depleted uranium fill material internally can decrease the overall weight of the waste package design. Furthermore, if boron is included in the depleted uranium fill material, the neutron shielding in the walls of the waste package might be reduced or even completely eliminated. In all cases, the depleted uranium fill material provides the primary reduction in gamma radiation levels.

Also, it is important that the waste package containing the spent nuclear fuel assemblies have good structural integrity so as to withstand severe accidents which may occur during transport. The waste package must ensure that spent nuclear fuel geometries are maintained under accident conditions and are not altered by rapid acceleration or deceleration. Because the depleted uranium fill material substantially fills the voids in and around the assemblies, the depleted uranium fill material acts as a packing agent for the spent nuclear fuel assemblies, dampening vibrations during normal operations and maintaining geometries under accident condition, thus increasing the overall structural integrity of the waste package.

EXAMPLE

The following example is given to illustrate the method of the present invention and is not to be taken as limiting the scope of the invention which is defined in the appended claims. The Table shows a comparison of various properties of a waste package system using both depleted uranium (DU) silicate fill material and depleted uranium (DU) dioxide fill material. The waste package system employed here is the 125-ton U.S. Multi-Purpose (MPC) waste package system designed as a repository waste package for the U.S. Department of Energy. The MPC is a thin-walled, stainless steel container containing fuel baskets for storing 21 light-water reactor spent nuclear fuel assemblies. The MPC has an internal volume of 7.9 $m^3$; the spent nuclear fuel baskets have a solid volume of 1.1 $m^3$ and the 21 spent nuclear fuel assemblies have a solid volume of 1.6 $m^3$. The fuel assemblies are mostly empty coolant channels. Accordingly, a total of 5.2 $m^3$ of the 7.9 $m^3$ (about 66%) of the MPC internal volume can be filled with the depleted uranium fill material. The fraction of any waste package that is void space depends. upon the waste package size and fuel type, but in all light-water reactor spent nuclear fuel waste package designs, most of the waste package volume is void space.

TABLE

PROPERTY COMPARISONS FOR MPC WASTE PACKAGE USING DEPLETED URANIUM (DU) FILL MATERIAL

| | Fill Material | |
|---|---|---|
| Property | DU Silicate | DU Dioxide |
| SNF (MTIHM*) | 9.96 | 9.96 |
| Solid Bead Density (g/cm$^3$) | 4.1 | 10.96 |
| Wt. % DU | 25 | 88 |
| DU Mass (t) | 3.43 | 32.3 |
| Bead Mass (t) | 13.7 | 36.7 |
| Ratio DU/SNF | 0.35 | 3.33 |
| Bead Mass (t) | 13.7 | 36.7 |
| DU $^{235}$U assay (wt. %) | 0.2 | 0.2 |
| SNF $^{235}$U assay (wt. %) | 1.6 | 1.6 |
| WP $^{235}$U equivalent (wt. %) | 1.24 | 0.53 |

*Metric tons initial heavy metals

The Table shows that for depleted uranium dioxide, the enrichment level of the sealed MPC waste package is below 1 wt. % uranium-235 equivalent. For depleted uranium silicate glass, the enrichment level of the sealed MPC waste package is about 1.24 wt. % uranium-235 equivalent. These enrichment levels are the result of substantially filling the available void space in and around the spent nuclear fuel assemblies. Lower enrichments are possible by increasing the waste package size beyond that needed for spent nuclear fuel.

While the method of the present invention can be used for packaging light-water reactor spent nuclear fuel, the method can also be used for packaging other types of spent nuclear fuel, such as research and naval reactor, for long-term disposal in geological repositories.

In addition, during the uranium enrichment process to produce nuclear fuel, typically four to six tons of depleted uranium are produced per ton of enriched uranium nuclear fuel. The U.S. Department of Energy is responsible for managing this material and is examining options for its beneficial use. The use of depleted uranium fill material in the form of depleted uranium silicate glass or depleted uranium dioxide eliminates the cost of disposal of the depleted uranium by-product.

Thus, it will be seen that a method for packaging spent nuclear fuel for long-term disposal in a geological repository has been provided. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for packaging spent nuclear fuel for long-term disposal in a geological repository, comprising the steps of:

a) placing at least one spent nuclear fuel assembly in an unsealed waste package;

b) adding a fill material to said waste package, said fill material comprising flowable particles having a size sufficient to substantially fill any voids in and around said assembly and containing isotopically-depleted uranium in the +4 valence state in an amount sufficient to inhibit dissolution of said spent nuclear fuel from said assembly into a surrounding medium and to lessen the potential for nuclear criticality inside said repository in the event of failure of said waste package; and c) sealing said waste package to allow for disposal of said assembly in said repository, thereby substantially reducing the release of radionuclides from said waste package into said surrounding medium in the event of failure of said waste package, while simultaneously providing radiation shielding and increased structural integrity of said waste package.

2. The method as in claim 1, wherein said surrounding medium is groundwater.

3. The method as in claim 2, wherein said flowable particles have a size in the range of from about 0.1 to about 1 mm.

4. The method as in claim 3, wherein said flowable particles are in the form of generally spherical beads.

5. The method as in claim 4, wherein said generally spherical beads have a diameter in the range of from about 0.1 to about 1 mm.

6. The method as in claim 5, wherein said spent nuclear fuel in said assembly comprises uranium dioxide fuel pellets.

7. The method as in claim 6, wherein said fill material is a member selected from the group consisting of depleted uranium oxides and depleted uranium silicate glass.

8. The method of claim 7, wherein said fill material has an isotopically-depleted uranium content in the range of from about 99.6 to about 99.8 percent by weight of uranium-238.

9. The method of claim 8, wherein said fill material has a solid density in the range of from about 4 to about 11 g/cm$^3$.

10. The method of claim 9, wherein said fill material has a particulate density in the range of from about 2.0 to about 9.9 g/cm$^3$.

11. The method of claim 10, wherein said fill material comprises depleted uranium dioxide.

12. The method of claim 11, wherein said sealed waste package containing said spent nuclear fuel and said added fill material has an enrichment level of less than 1.0 percent by weight of uranium-235 equivalent.

13. The method of claim 10, wherein said fill material comprises depleted uranium silicate.

14. The method of claim 13, wherein said sealed waste package containing said spent nuclear fuel and said added fill material has an enrichment level of less than 1.3 percent by weight of uranium-235 equivalent.

* * * * *